US005540388A

United States Patent [19]

Sasao

[11] Patent Number: 5,540,388

[45] Date of Patent: Jul. 30, 1996

[54] SOLENOID TYPE FUEL INJECTION VALVE

[75] Inventor: Isamu Sasao, Miyagi, Japan

[73] Assignee: Kabushiki Kaisha Keihinseiki Seisakusho, Tokyo, Japan

[21] Appl. No.: 352,095

[22] Filed: Nov. 30, 1994

[30] Foreign Application Priority Data

Mar. 25, 1994 [JP] Japan ..... 6-056351
Jun. 21, 1994 [JP] Japan ..... 6-139149

[51] Int. Cl.[6] ..... F02M 51/00

[52] U.S. Cl. ..... 239/417.3; 239/429; 239/585.4

[58] Field of Search ..... 239/533.3, 533.12, 239/585.1, 585.5, 545, 433, 403, 416.5, 417.3, 418, 421, 424.5, 425, 421.3, 42.9

[56] References Cited

U.S. PATENT DOCUMENTS

| | | | |
|---|---|---|---|
| Re. 33,841 | 3/1992 | Rush et al. | 239/585.4 X |
| 3,929,291 | 12/1975 | Ladich | 239/433 X |
| 4,666,088 | 5/1987 | Krauss et al. | 239/533.12 |
| 4,771,948 | 9/1988 | Fukukawa et al. | 239/585.4 X |
| 5,197,674 | 3/1993 | Ketterer et al. | 239/585.4 X |

FOREIGN PATENT DOCUMENTS

| | | | |
|---|---|---|---|
| 325244 | 11/1934 | Italy | 239/433 |
| 327607 | 7/1935 | Italy | 239/533.12 |
| 57-120758 | 7/1982 | Japan . | |
| 58-90365 | 6/1983 | Japan . | |
| 63-31261 | 2/1988 | Japan . | |
| 1-95572 | 6/1989 | Japan . | |
| 5-67786 | 9/1993 | Japan . | |
| 405248325 | 9/1993 | Japan | 239/533.12 |
| 1239456 | 6/1986 | U.S.S.R. | 239/433 |

*Primary Examiner*—Kevin P. Weldon
*Attorney, Agent, or Firm*—Armstrong, Westerman, Hattori, McLeland & Naughton

[57] ABSTRACT

In a solenoid type fuel injection valve, outer and inner fuel spray guide devices are coaxially disposed downstream of a fuel injection hole, and a pintle is provided at a tip end of a needle valve and projects to extend through the fuel injection hole and opposed to an upper surface of the inner fuel spray guide device. Thus, fuel passing through the fuel injection hole to collide against a valve head of the pintle is sprayed into an intake port, while being atomized and spread into a cone-like shape. At this time, the fuel is blocked by a support arm which extends radially inwardly from a cap to support the inner fuel spray guide device, thereby causing a fuel spray pattern to be formed into a horse's hoof-like shape having fuel non-spray portions. By forming the fuel non-spray portions in correspondence to a rod portion of an intake valve and/or the like, the deposition of the fuel is prevented.

8 Claims, 12 Drawing Sheets

SOLENOID TYPE FUEL INJECTION VALVE

BACKGROUND OF THE INVENTION

1. Field of the Invention

The present invention relates to a solenoid type fuel injection valve for injecting a fuel into an intake port in an engine.

2. Description of the Related Art

There are such conventionally known solenoid type fuel injection valves described in Japanese Utility Model Application Laid-open Nos. 90365/83, 31261/88 and 120758/82, Japanese Patent Publication No. 67786/93 and Japanese Utility Model Application Laid-open No. 95572/89.

In the solenoid type fuel injection valves described in Japanese Utility Model Application Laid-open Nos. 90365/83 and 31261/88, a fuel collision portion is provided, coaxially with a needle valve, at a tip end of the fuel injection valve through a support member. These fuel injection valves suffer from a problem that a fuel spray pattern is formed mainly by an energy of injection of a fuel and hence, it is difficult to produce any desired fuel spray pattern. Especially when the amount of fuel supply is small, the fuel spray pattern is largely varied. Moreover, there is another problem that the atomization of the fuel is difficult to promote, because the fuel collision portion has a triangular pyramid shape.

In the solenoid type fuel injection valves described in Japanese Utility Model Application Laid-open No. 120758/82 and Japanese Patent Publication No. 67786/93, fuel is injected into two intake valves by a single fuel injection valve. In the solenoid type fuel injection valve described in Japanese Utility Model Application Laid-open No. 95572/89, a fuel is injected to three intake valves by a single fuel injection valve. These fuel injection valves are designed to prevent the deposition of the fuel onto a wall surface of the intake port, but suffer from a problem in that it is impossible to avoid the deposition of the fuel onto a rod portion of the intake valve.

SUMMARY OF THE INVENTION

Accordingly, it is an object of the present invention to provide a solenoid type fuel injection valve, wherein it is possible to prevent the deposition of the fuel onto the rod portion of the intake valve and the wall surface of the intake port, and to provide the atomization, uniformization and stabilization in particle size of the injected fuel.

To achieve the above object, according to a first aspect and feature of the present invention, there is provided a solenoid type fuel injection valve comprising: a fuel injection hole formed in an injector body and opened and closed by a needle valve; a cap mounted at a tip end of the injector body; a cylindrical outer fuel spray guide means retained within the cap so as to be located at a position downstream of the fuel injection hole for limiting a spray angle of a fuel; a pintle provided at a tip end of the needle valve to extend through the fuel injection hole into the outer fuel spray guide means for atomizing the fuel passed through the fuel injection hole; an inner fuel spray guide means disposed within the outer fuel spray guide means at a position downstream of the pintle and coaxially opposed to a tip end of the pintle; and a support arm extending radially inwardly from the cap for supporting the inner fuel spray guide means.

In addition to the first feature, a second feature of the present invention is that a plurality of the support arms are provided.

In addition to the first feature, a third feature of the present invention is that the solenoid type fuel injection valve further includes an air assist passage which is opposed to the tip end of the pintle and opens into the inner fuel spray guide means.

In addition to the first feature, a fourth feature of the present invention is that a fuel spray is guided by an inner wall of the outer fuel spray guide means and an outer wall of the inner fuel spray guide means.

With the first feature of the present invention, non-spray portions can be formed in the fuel spray pattern defined into a cone-like shape by the outer fuel spray guide means and the inner fuel spray guide means, by blocking the fuel spray by the support arm. Therefore, it is possible to prevent the deposition of the fuel onto the rod portion and wall surface by forming the non-spray portions so as to correspond to a rod portion of an intake valve and a preselected wall surface of an intake port, thereby avoiding a variation in air-fuel ratio. Moreover, the outer fuel spray guide means, the inner fuel spray guide means and the support arm need only be added to the prior art solenoid fuel injection valve including the pintle and therefore, it is possible to realize the solenoid fuel injection valve according to the present invention at an extremely low cost.

With the second feature of the present invention, the fuel spray pattern can be divided into a plurality of crescent-shaped portions by the provision of the plurality of support arms, thereby further effectively avoiding the deposition of the fuel onto the rod portion of the intake valve and the wall surface of the intake port.

Further, with the third feature of the present invention, it is possible to provide the atomization, uniformization and stabilization in particle size of the injected fuel by the provision of the air assist passage opposed to the tip end of the pintle and opening into the inner fuel spray guide means.

Yet further, with the fourth feature of the present invention, it is possible to spread the fuel spray into a correct cone-like shape by guiding the fuel spray by the inner wall of the outer fuel spray guide means and the outer wall of the inner fuel spray guide means.

According to a fifth aspect and feature of the present invention, there is provided a solenoid type fuel injection valve comprising: a fuel injection hole formed in an injector body and opened and closed by a needle valve; a cylindrical fuel spray guide means provided at a position downstream of the fuel injection hole for limiting a spray angle of a fuel; a pintle provided at a tip end of the needle valve to extend through the fuel injection hole into the fuel spray guide means for atomizing the fuel passed through the fuel injection hole; and an air assist passage disposed within the fuel spray guide means at a position downstream of the pintle and coaxially opposed to a tip end of the pintle.

With the fifth feature, since the air assist passage provided at a position downstream of the pintle is axially opposed to the tip end of the pintle, it is possible not only to equally mix air to the fuel to promote the atomization and uniformization of the fuel, but also to allow the air to collide against the fuel at a large relative speed to provide the stabilization in particle size.

Further, according to a sixth aspect and feature of the present invention, there is provided a solenoid type fuel injection valve comprising a fuel injection hole provided in an injector body and capable of opening and closing by a needle valve wherein assist air can be supplied toward a fuel flow injected through the fuel injection hole, the fuel injection valve further including: a cylindrically formed outer fuel spray guide means provided in the injector body at a position downstream of the fuel injection hole for limiting a spray angle of a fuel; a pintle provided at a tip end of the needle valve to extend through the fuel injection hole and inserted into the outer fuel spray guide means; an inner fuel spray guide means fixedly disposed within the outer fuel spray guide means and coaxially opposed to the pintle; a fuel injection passage formed between the inner fuel spray guide means and the outer fuel spray guide means; a first air assist passage which is provided in the inner fuel spray guide means and which opens in an opposed relation to a tip end of the pintle; and a plurality of second air assist passages which are provided in the outer fuel spray guide means at a position corresponding to the fuel injection passage and which open toward the inner fuel spray guide means.

With the sixth feature, it is possible to promote the atomization and uniformization of the fuel by the assist air from the first air assist passage and further promote the atomization and uniformization of the fuel by the assist air from the plurality of second air assist passages, thereby insuring the atomization and uniformization of the injected fuel and the stabilization of discharge form.

The above and other objects, features and advantages of the invention will become apparent from the following description of preferred embodiments taken in conjunction with the accompanying drawings.

DESCRIPTION OF THE PREFERRED EMBODIMENTS

A first embodiment of the present invention will be first described with reference to FIGS. 1 to 6.

Figure 1:
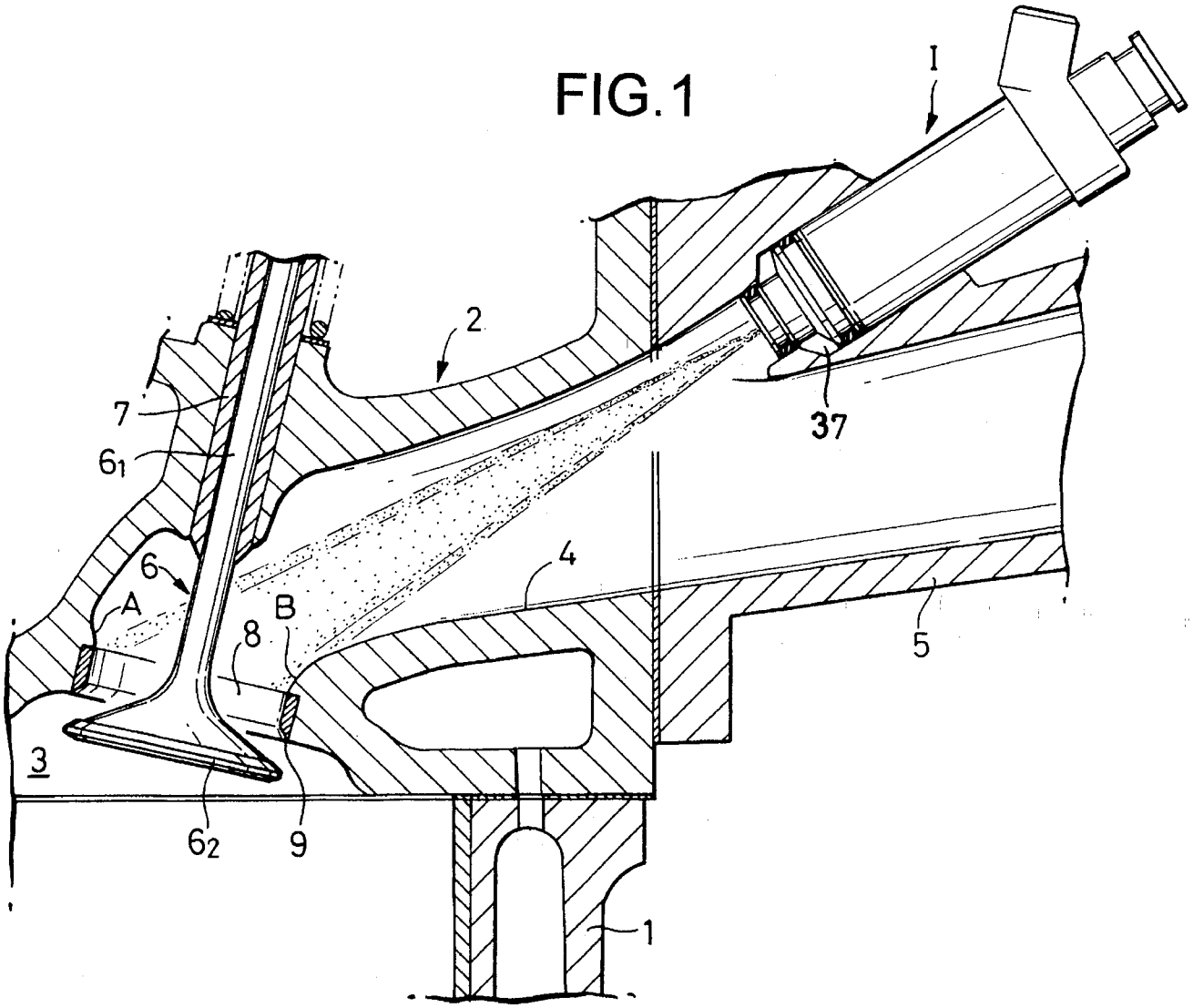
FIG. 1 is a vertical sectional side view of a portion of an engine including a solenoid type fuel injection valve according to a first embodiment of the present invention.

Referring to FIG. 1, an intake port 4 is defined in a cylinder head 2 coupled to an upper surface of a cylinder block 1 of an engine and is connected to a combustion chamber 3. An intake manifold 5 is connected to the intake port 4 and coupled to a side of the cylinder head 2. An intake valve 6 has a rod portion $\mathbf{6}_1$ and a valve head 62, so that the valve head $\mathbf{6}_2$ is seated onto and unseated away from a valve seat 8 to open and close an intake valve bore 9 by vertically moving the intake valve 6 with the rod portion $\mathbf{6}_1$ slidably guided on a valve guide 7 provided in the cylinder head 2 by a valve operating mechanism (not shown). A solenoid type fuel injection valve I is provided in the intake manifold 5, so that fuel is injected from the solenoid type fuel injection valve I through the intake port 4 into the intake valve bore 9.

Figure 2:
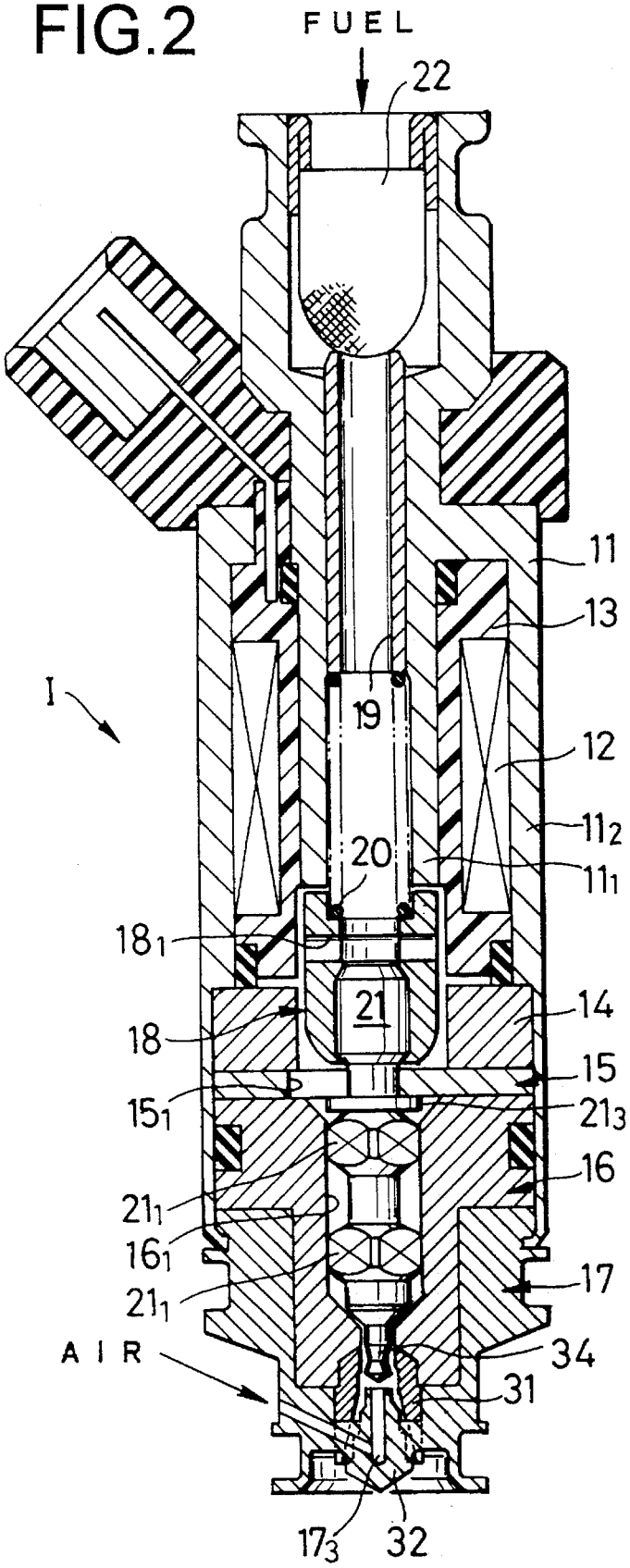
FIG. 2 is a vertical sectional side view of the fuel injection valve.

As shown in FIG. 2, the solenoid type fuel injection valve I includes a substantially cylindrical body housing 11. A bobbin 13 having a coil 12 wound around an outer periphery, a yoke 14, a stopper plate 15, an injector body 16 and a cap 17 are fitted within the body housing 11 from below in the named order and fixed by caulking a lower edge of the body housing 11 to an outer periphery of the cap 17. A portion of the body housing 11 located inside the bobbin 13 constitutes a stationary core $\mathbf{11}_1$, and a portion of the body housing 11 located outside the coil 12 constitutes a yoke $\mathbf{11}_2$. A movable core 18 is vertically movably accommodated in a space which is defined by an inner periphery of a lower portion of the bobbin 13 and an inner periphery of the yoke 14. A tubular spring seat 19 is press-fitted from above into the center of the body housing 11, and the movable core 18 is biased downwardly by a valve spring 20 which is mounted under compression between the movable core 18 and the spring seat 19.

Figure 3:
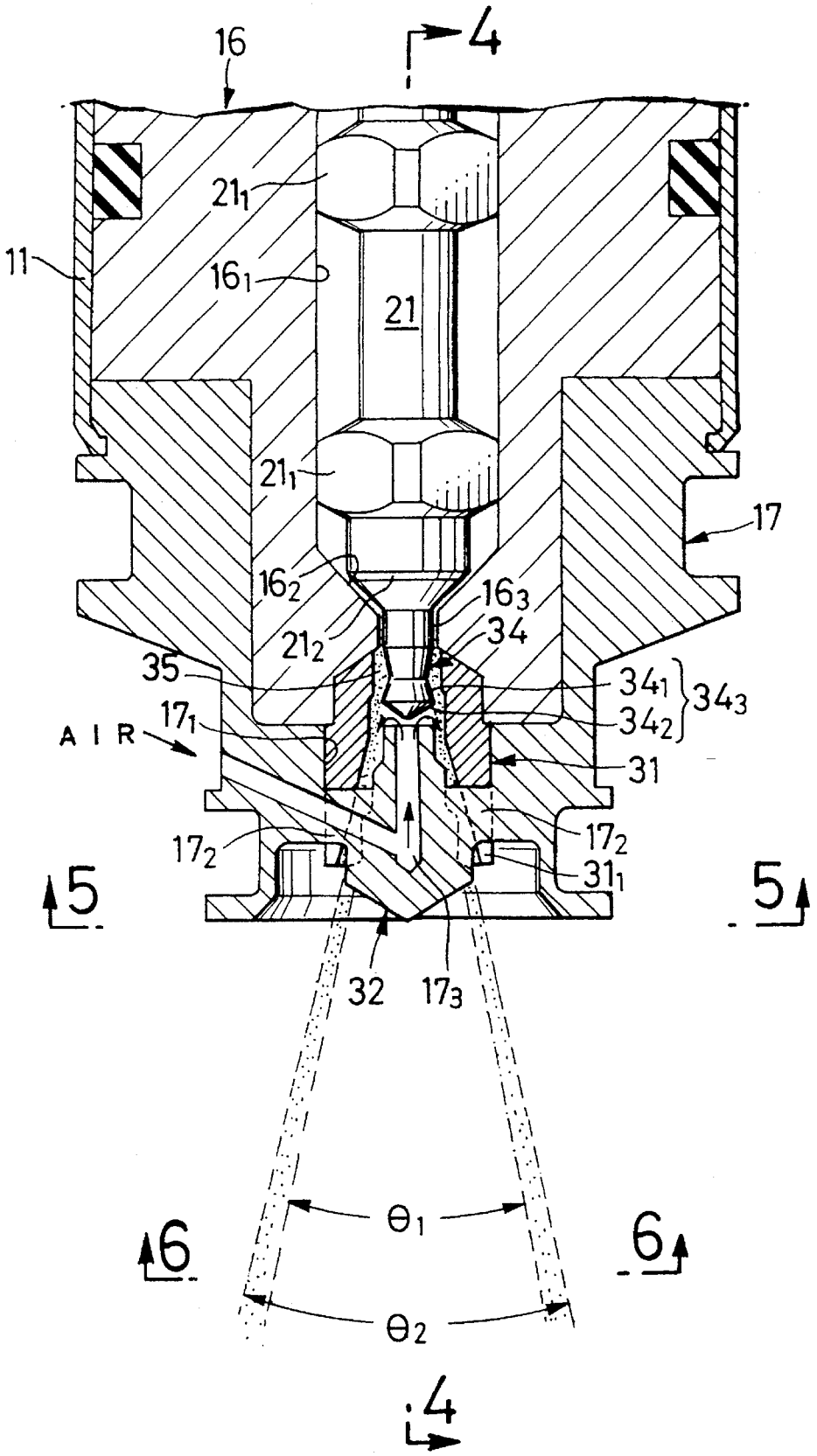
FIG. 3 is an enlarged view of an essential portion shown in FIG. 2.

As can be seen from FIGS. 1 and 2 in combination with FIG. 3, a needle valve 21 is fixed to the movable core 18 by caulking to extend downwardly, and has a pair of guide portions $\mathbf{21}_1$, $\mathbf{21}_1$ substantially rectangular in section and slidably fitted in a guide hole $\mathbf{16}_1$ which are circular in section and provided in the injector body 16. A valve portion $\mathbf{21}_2$ formed at a lower portion of the needle valve 21 is seatable on a valve seat $\mathbf{16}_2$ connected to a lower portion of the guide hole $\mathbf{16}_1$. Thus, an annular fuel injection hole $\mathbf{16}_3$ is opened and closed by the valve portion $\mathbf{21}_2$ and the valve seat $\mathbf{16}_2$.

Figure 5:
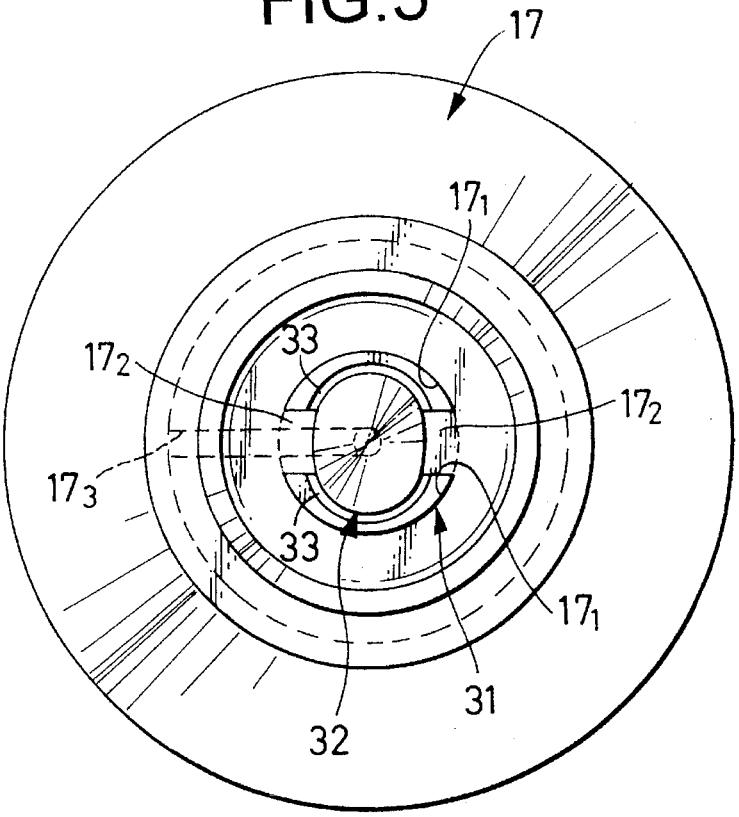
FIG. 5 is a sectional view taken along a line 5—5 in FIG. 3.
Figure 6:
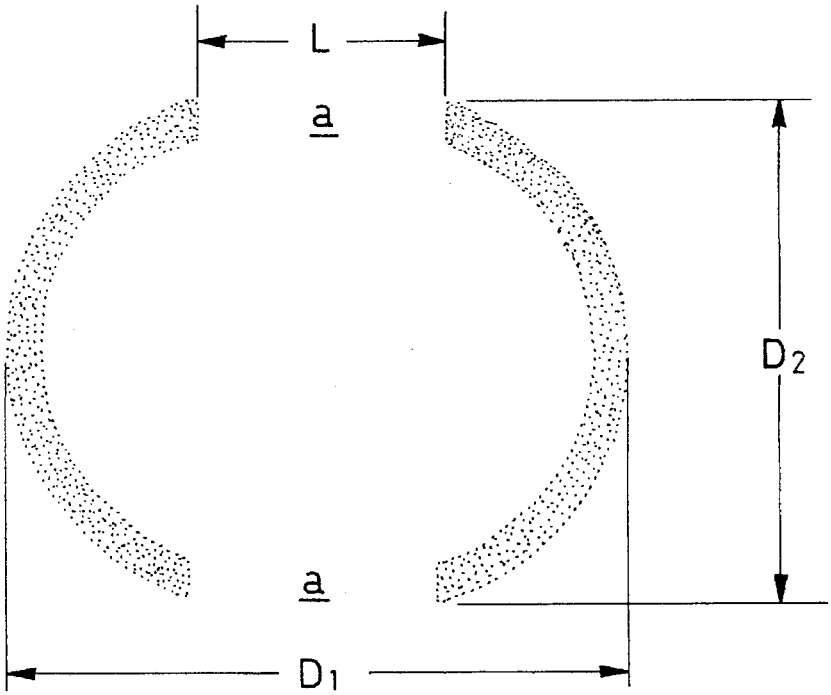
FIG. 6 is a sectional view taken along a line 6—6 in FIG. 3.

In a state where the coil 12 wound around the bobbin 13 is deenergized, the movable core 18 and the needle valve 21 are biased downwardly by a resilient force of the valve spring 20, so that the valve portion $\mathbf{21}_2$ is seated on the valve seat $\mathbf{16}_2$. When the coil 12 is energized to attract the movable core 18 upwardly against the resilient force of the valve spring 20, the needle valve 21 is moved upwardly so that the valve portion $\mathbf{21}_2$ is spaced apart from the valve seat $\mathbf{16}_2$. FIGS. 3, 5 and 6 show the needle valve 21 in a condition in which it has been moved upwardly and thus, the valve portion $21_2$ has been spaced apart from the valve seat, thereby opening the fuel injection hole $16_3$. At this time, the stroke of the needle valve 21 is limited by the abutment of a flange $21_3$ formed at an intermediate portion of the needle valve 21 against a lower surface of the stopper plate 15.

When the fuel injection hole $16_3$ has been opened in the above manner, fuel supplied to an upper end of the body housing 11 from a fuel supply source (not shown) is passed through a filter 22, an internal space of the spring seat 19, a through-hole $18_1$ of the movable core 18, an internal space of the yoke 14, a through-hole $15_1$ in the stopper plate 15, clearances between the guide hole $16_1$ in the injector body 16 and the guide portions $21_1$, $21_1$ of the needle valve 21, a clearance between the valve portion $21_2$ and the valve seat $16_2$ and the fuel injection hole $16_3$ and then injected. At this time, the amount of fuel injected from the solenoid fuel injection valve I is metered by controlling the time length of energization of the coil 12.

Figure 4:
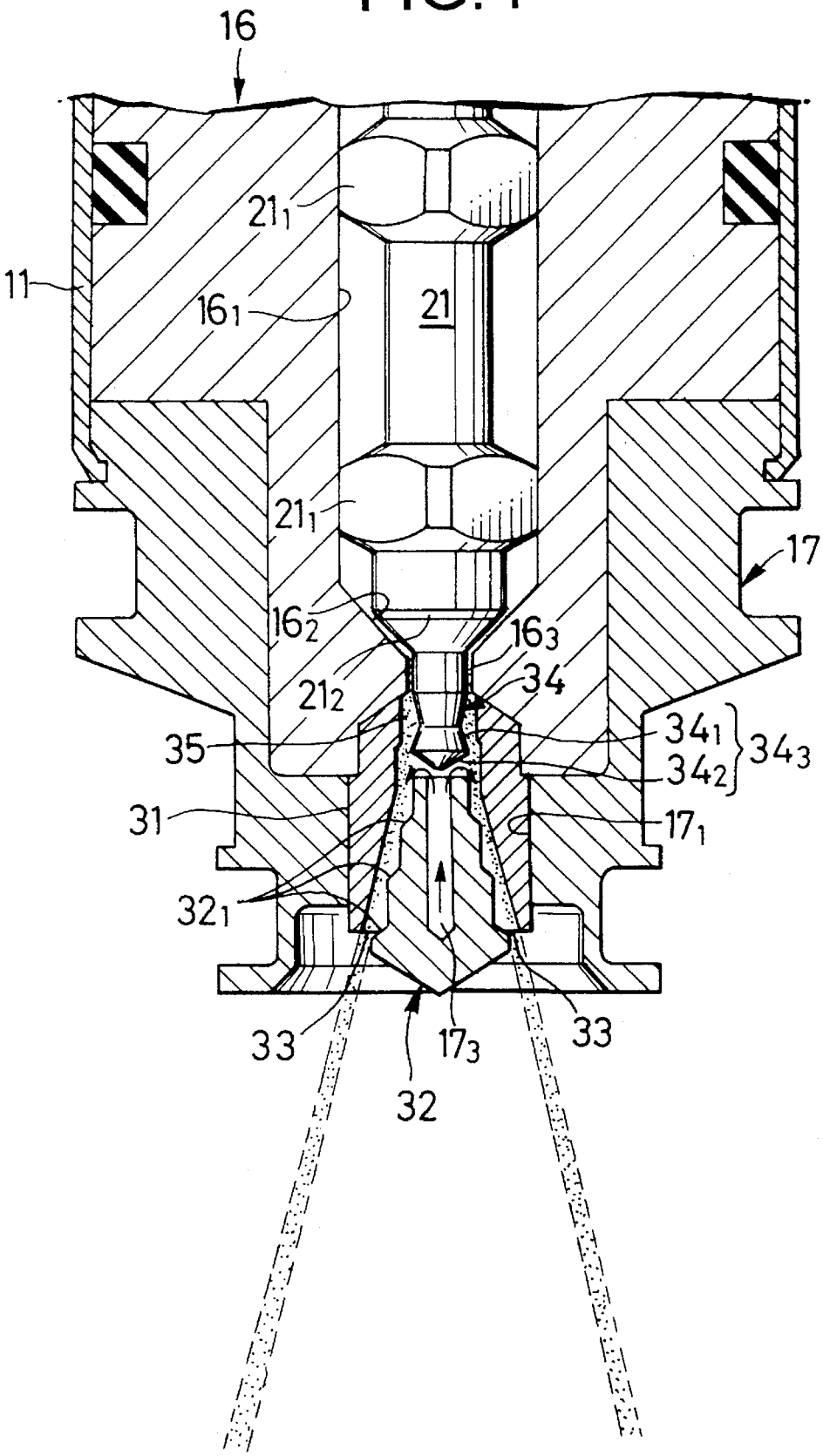
FIG. 4 is a sectional view taken along a line 4—4 in FIG. 3.

As shown in FIGS. 3 to 5, an outer cylindrical fuel spray guide means 31 is fitted and retained in a fitting hole $17_1$ defined in the cap 17 connected to a lower end of the injector body 16 to lie coaxially with the needle valve 21. A pair of support arms $17_2$, $17_2$ are formed at a lower end of the cap 17 to extend radially within the fitting hole $17_1$, and a spindle-shaped inner fuel spray guide means 32 is retained by the pair of support arms $17_2$, $17_2$. A pair of notches $31_1$, $31_1$ are defined at a lower end of the outer fuel spray guide means 31 and fitted to the pair of support arms $17_2$, $17_2$ for the inner fuel spray guide means 32. Thus, the outer fuel spray guide means 31 is disposed coaxially with the inner fuel spray guide means 32, and a pair of opposed crescent-shaped nozzles 33, 33 are formed between an inner periphery of the outer fuel spray guide means 31 and an outer periphery of the inner fuel spray guide means 32.

A pintle 34 is integrally formed at a lower end of the needle valve 21 to extend downwardly within the outer fuel spray guide means 31, and has a valve head $34_3$ formed at its lower end, which has an upwardly-turned tapered surface $34_1$ and a downwardly-turned tapered surface $34_2$. Thus, the fuel passing through the fuel injection hole $16_3$ collides against the valve head $34_3$ of the pintle 34 and is thereby atomized and spread into a cone-like shape having an inner spray angle $\theta_1$ and an outer spray angle $\theta_2$.

The cap 17 is provided with an air assist passage $17_3$ which extends radially inwardly from an outer peripheral surface of the cap 17 through one of the support arms $17_2$ to the center of the inner fuel spray guide means 32 and then extends upwardly therefrom to open into an upper surface of the inner fuel spray guide means 32 at its central portion. The opening of the air assist passage $17_3$ is coaxially opposed to a tip end of the valve head $34_3$ of the pintle 34 (i.e., a tip end of the downwardly-turned tapered surface $34_2$). An annular air chamber 37 (see FIG. 1) is defined between the housing body 11 of the solenoid type fuel injection valve I and the intake manifold 5 and connected to an air supply source (not shown), and an outer end of the air assist passage $17_3$ opens into the air chamber 37. Thus, when air is supplied from the air chamber 37 to the air assist passage $17_3$, the air is blown upwardly against the tip end of the downwardly-turned tapered surface $34_2$ of the pintle 34.

Wall surfaces of passages which connect an annular expansion chamber 35 defined between an outer periphery of the pintle 34 and the inner periphery of the outer fuel spray guide means 31 with the pair of nozzles 33, 33, i.e., the inner wall of the outer fuel spray guide means 31 and the outer wall of the inner fuel spray guide means 32 are spread in a divergent manner to meet the outer spray angle $\theta_2$ and the inner spray angle $\theta_1$. The inner wall of the outer fuel spray guide means 31 is formed into a smooth surface free from a projection, and the outer wall of the inner fuel spray guide means 32 is provided with annular steps $32_1$ (see FIG. 4) disposed at three stages to meet the inner spray angle $\theta_1$.

The operation of the first embodiment of the present invention having the above-described construction will be described below.

When the coil 12 of the solenoid type fuel injection valve I is energized to move the needle valve 21 upwardly, the valve portion $21_2$ of the needle valve 21 is unseated away from the valve seat $16_2$ to open the fuel injection hole $16_3$, thereby causing the high pressure fuel to be injected through the fuel injection hole $16_3$ into the annular expansion chamber 35. The fuel injected into the annular expansion chamber 35 collides against the upwardly-turned tapered surface $34_1$ of the valve head $34_3$ of the pintle 34, whereby it is atomized while being radially diffused. At this time, air blown through the air assist passage $17_3$ against the downwardly-turned tapered surface $34_2$ of the valve head $34_3$ of the pintle 34 is radially diffused to collide against the atomized fuel, whereby it is uniformly mixed with such air and hence, the atomization of the fuel is further promoted. In this case, the air ejected from the air assist passage $17_3$ collides against the fuel at a large relative speed in a confronting manner and hence, the atomization of the fuel is further promoted to provide a stabilization in particle size.

The fuel atomized in the above manner is guided through the divergent passage defined between the inner wall of the outer fuel spray guide means 31 and the outer wall of the inner fuel spray guide means 32 and is sprayed from the pair of crescent-shaped nozzles 33, 33 formed at the lower end of the cap into the intake port 4. During this time, a reduction in flow speed is prevented by the annular steps $32_1$ formed at the three stages on the inner fuel spray guide means 32. The fuel passing through the nozzles 33, 33 is spread into a cone-like shape and sprayed toward a clearance defined between the intake valve bore 9 and the valve head $6_2$ of the intake valve 6.

Since the pair of nozzles 33, 33 are separated from each other by the support arms $17_2$, $17_2$, a fuel spray pattern is formed as shown in FIG. 6. More specifically, the fuel spray pattern is of a substantially elliptical shape with a longer diameter $D_1$ and a shorter diameter $D_2$ and having non-spray portions a, a having a length L and formed at mutually opposed locations by the support arms $17_2$, $17_2$. The fuel spray pattern is comprised of a pair of crescent-shaped portions spaced apart from each other by the length L.

As can be seen from FIG. 1, an axis of the solenoid type fuel injection valve I and an axis of the rod portion 61 of the intake valve 6 intersect each other at a predetermined angle and hence, the shape of the intake valve bore 9 as viewed from the axial direction of the solenoid type fuel injection valve I is elliptical rather than circular. Therefore, if the fuel spray pattern is formed into a circular shape, a following problem is encountered: the fuel spray collides against a wall surface of the intake port 4 at portions of the intake valve bore 9 indicated by A and B and is not smoothly introduced through the intake valve bore 9 into the combustion chamber 3 which results in being the fuel deposited onto the wall surface of the intake port 4, resulting in a variation in air-fuel ratio. However, forming the fuel spray pattern into a substantially elliptical shape to conform to the projected shape of the intake valve bore 9 as in this embodiment, makes it unlikely that the fuel spray will collide with portions A, B of the intake valve bore 9 thereby overcoming such problem.

Moreover, since the fuel spray pattern in this embodiment has the pair of non-spray portions a, a which correspond to the portions A and B, the collision of the fuel spray against the wall surface of the intake port 4 is further reliably avoided. Further, one of the non-spray portions a corresponds to the position of the rod portion $\mathbf{6}_1$ of the intake valve 6 and therefore, it is possible to avoid the collision of the fuel spray against the rod portion $\mathbf{6}_1$ to effectively prevent a variation in air-fuel ratio.

In addition, it is possible to establish the fuel spray pattern into any other shape by only changing the shape of the outer fuel spray guide means 31 and the shape of the inner fuel spray guide means 32 (i.e., the shape of the cap 17) and therefore, a solenoid type fuel injection valve I having a general purpose property can be provided at a low cost.

Although the fuel spray pattern is formed in correspondence only to the single intake valve 6 in this embodiment, it will be appreciated that a fuel spray pattern may be formed in correspondence to a plurality of intake valves. For example, when two intake valves are mounted, a fuel spray pattern may be formed so that one of the crescent-shaped spray portions corresponds to one of the intake valves, and the other crescent-shaped spray portion corresponds to the other intake valve. In this way, the present invention is applicable to a dual-intake engine while providing the same effect as in this embodiment by utilizing the crescent-shaped spray portions in correspondence to a plurality of intake valves, respectively.

Figure 7:
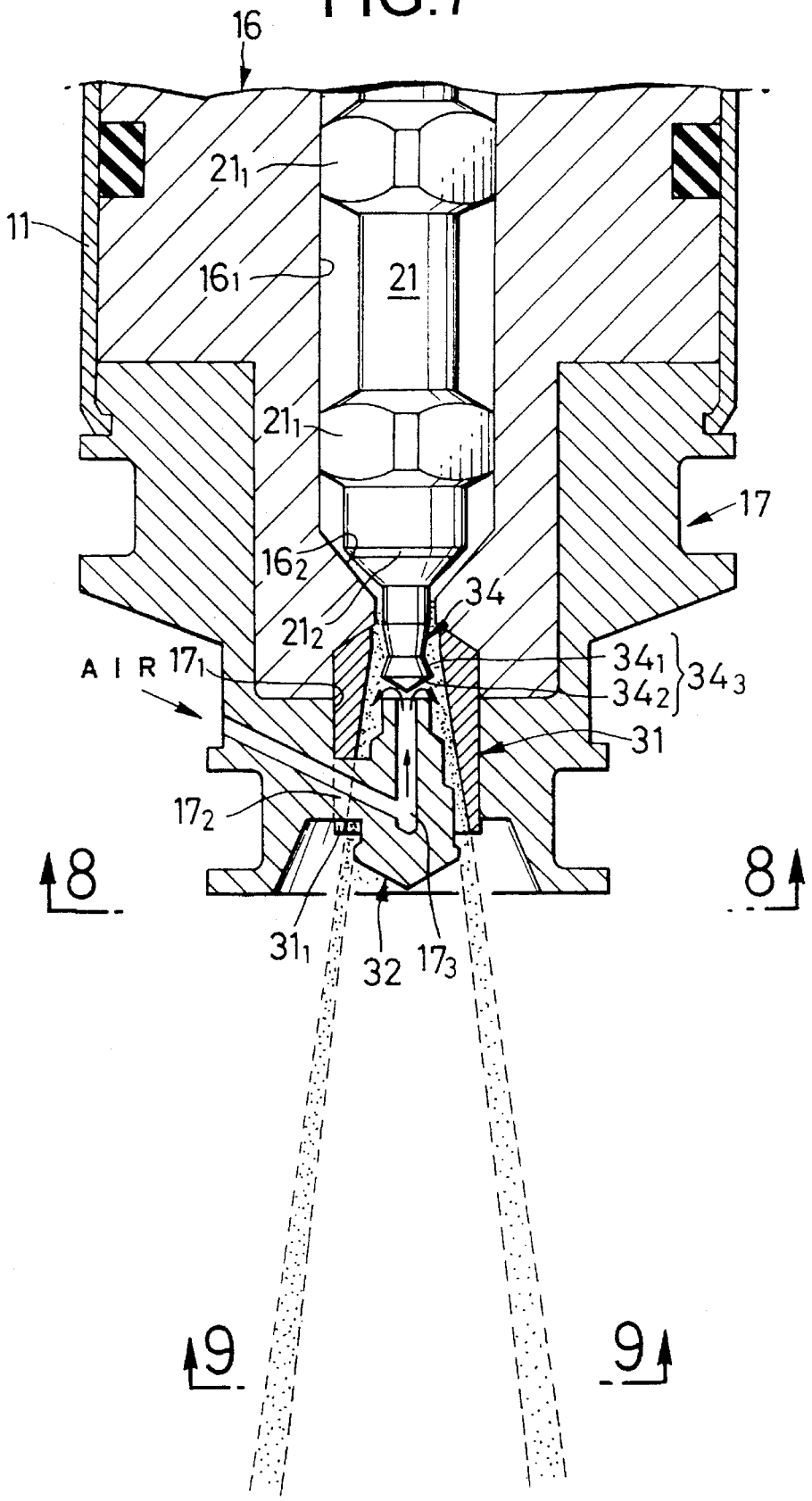
FIG. 7 is a vertical sectional side view of an essential portion of a solenoid type fuel injection valve according to a second embodiment of the present invention.
Figure 8:
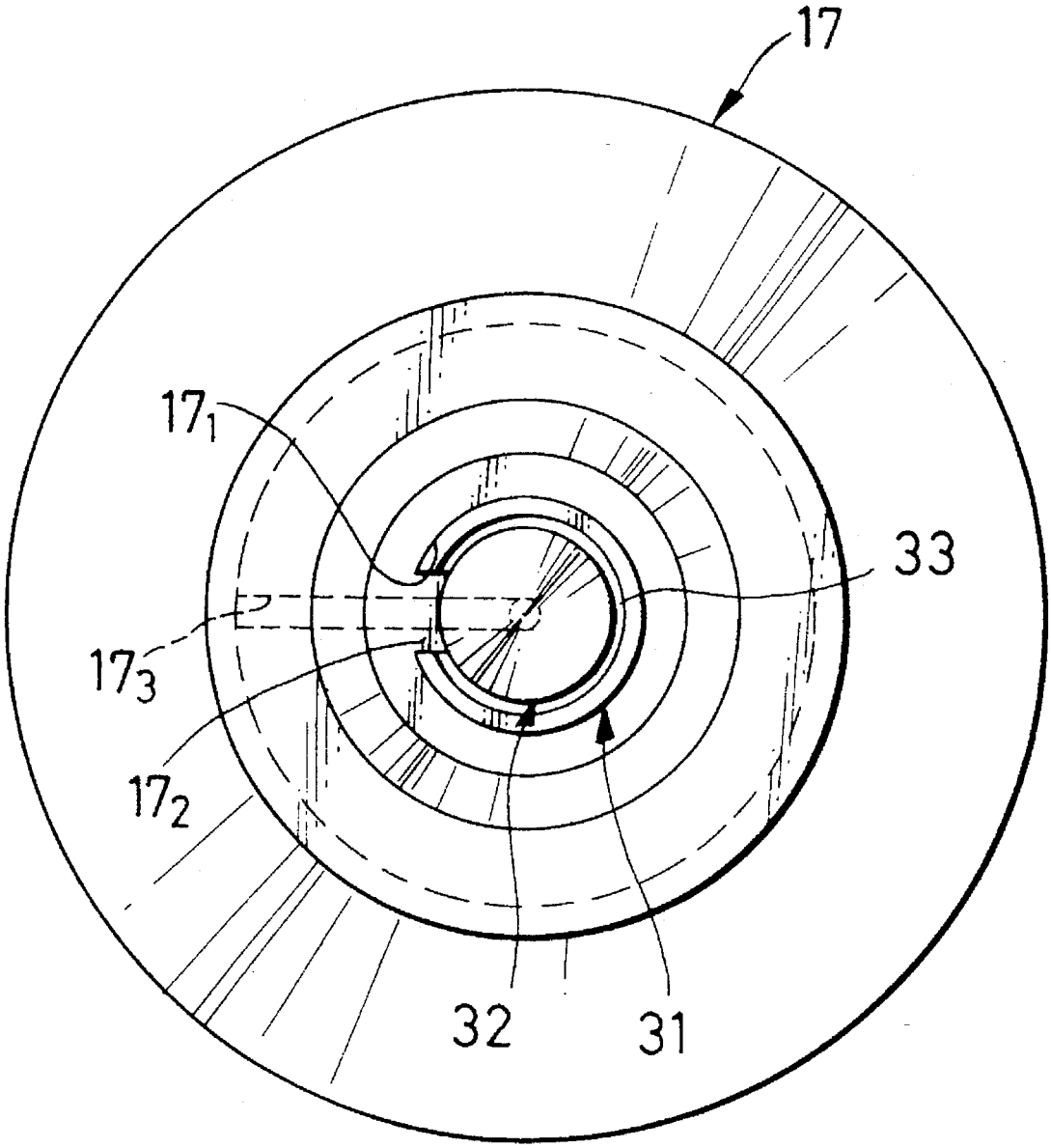
FIG. 8 is a view taken along a line 8—8 in FIG. 7.
Figure 9:
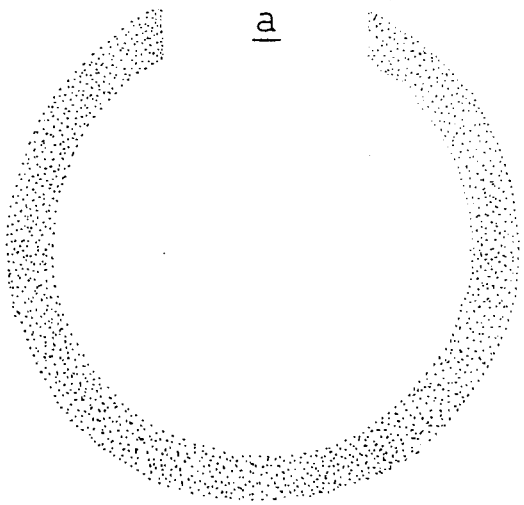
FIG. 9 is a sectional view taken along a line 9—9 in FIG. 7.

FIGS. 7 to 9 illustrate a second embodiment of the present invention, wherein portions or components corresponding to those in the first embodiment are designated by like reference characters.

In a solenoid type fuel injection valve I of the second embodiment, an inner fuel spray guide means 32 is supported by a single support arm $\mathbf{17}_2$. Therefore, a single nozzle 33 is provided and has a horse's hoof-like shape which is an incomplete circle. A fuel spray pattern is formed into a shape shown in FIG. 9, which has a single non-spray portion a in a portion of a circle.

In the second embodiment, the non-spray portion a of the fuel spray pattern corresponds to the position of the rod portion $\mathbf{6}_1$ of the intake valve 6. Thus, it is possible to avoid the collision of a fuel spray against the rod portion $\mathbf{6}_1$ and the portion A of the intake port 4 to prevent a variation in air-fuel ratio. Additionally, in the second embodiment, it is possible to perform the atomization, uniformization and stabilization in particle size of the fuel by blowing air through the air assist passage $\mathbf{17}_3$ against the pintle 34, as in the first embodiment.

Figure 10:
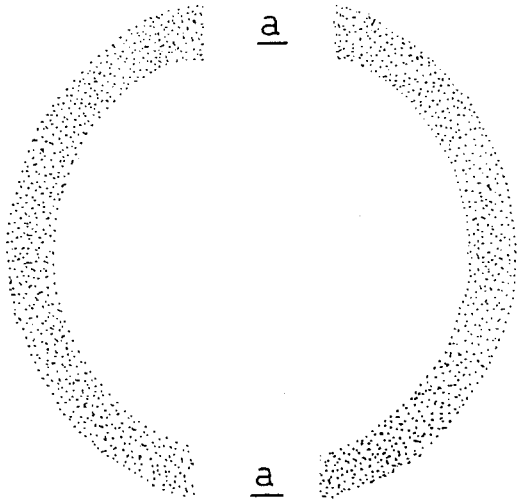
FIG. 10 is a sectional view similar to FIG. 6, but showing a modification of a fuel spray pattern.
Figure 11:
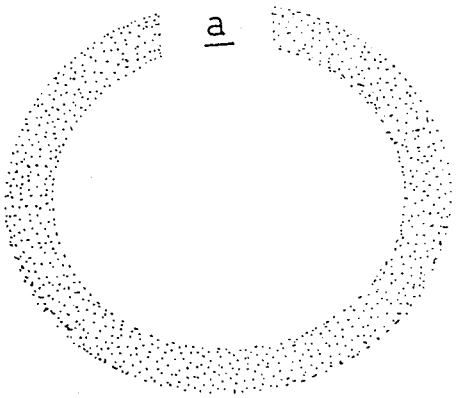
FIG. 11 is a sectional view similar to FIG. 6, but showing another modification of a fuel spray pattern.
Figure 12:
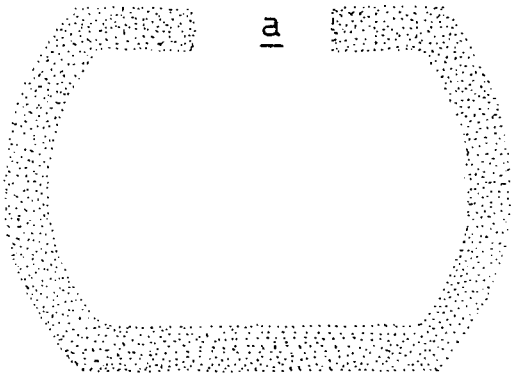
FIG. 12 is a sectional view similar to FIG. 6, but showing a further modification of a fuel spray pattern.

Although the outer fuel spray guide means 31 is formed by the independent member in each of the above-described embodiments, it will be appreciated that the outer fuel spray guide means 31 may be integral with the injector body 16 or the cap 17. In addition, although the inner fuel spray guide means 32 is integral with the cap 17 in each of the above-described embodiments, the inner fuel spray guide means 32 may be formed by an independent member. Annular projecting steps may also projectingly be provided on the inner wall of the outer fuel spray guide means 31. The fuel spray pattern may be changed properly in accordance with the shape of the intake port 4. The fuel spray pattern in the first embodiment may be changed into a fuel spray pattern shown in FIG. 10, and the fuel spray pattern in the second embodiment may be changed into any of the fuel spray patterns shown in FIGS. 11 and 12.

Figure 13:
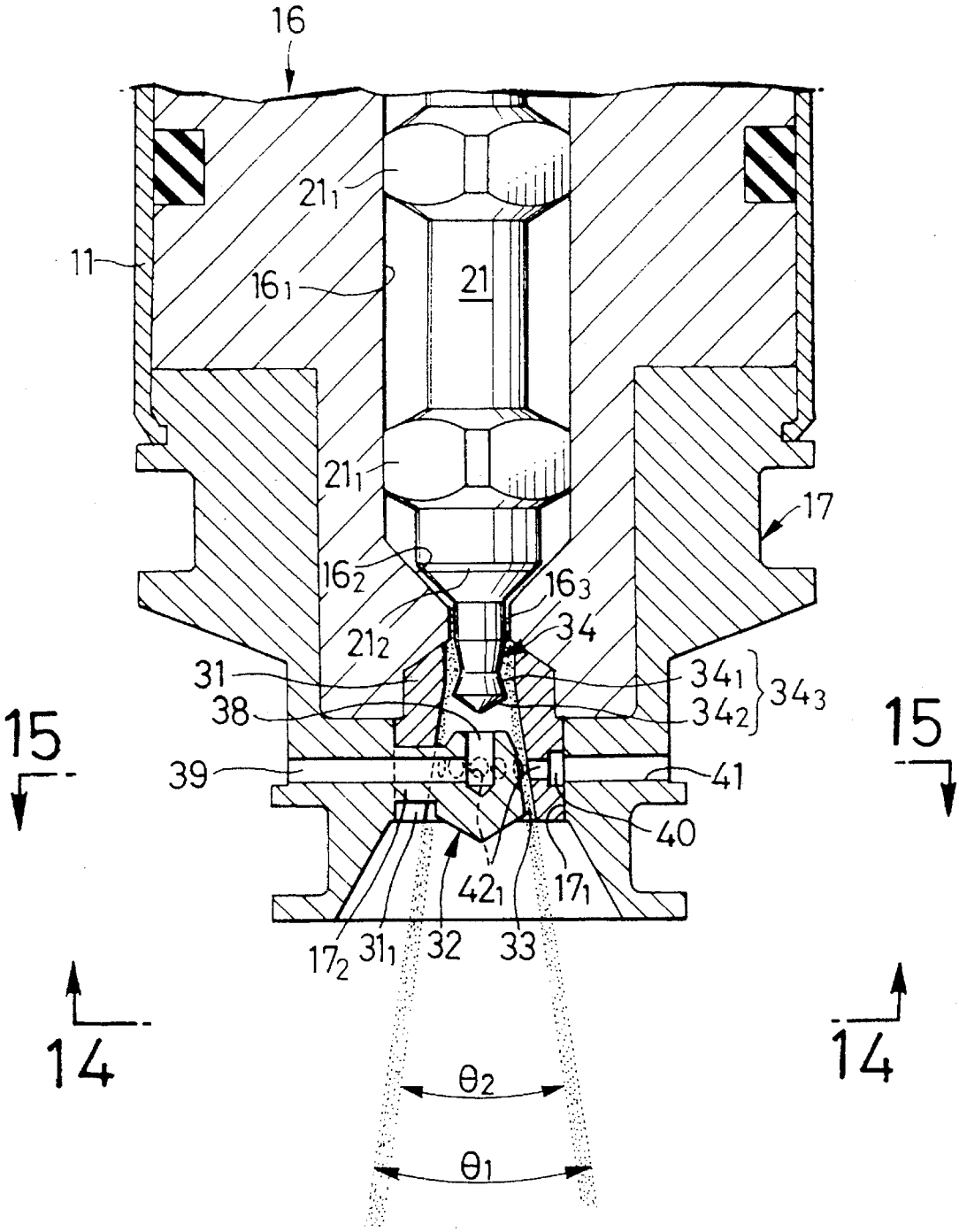
FIG. 13 is a vertical sectional side view of an essential portion of a solenoid type fuel injection valve according to a third embodiment of the present invention.
Figure 14:
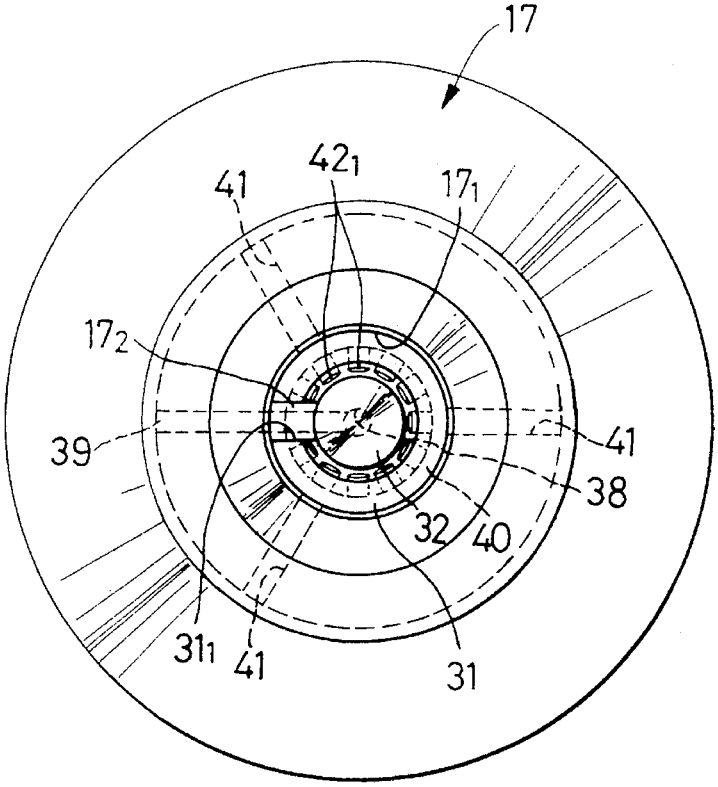
FIG. 14 is a view taken along a line 14—14 in FIG. 13.
Figure 15:
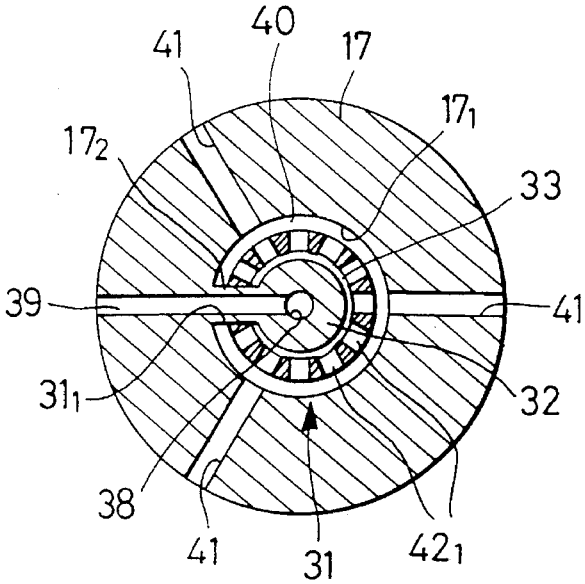
FIG. 15 is a sectional view taken along a line 15—15 in FIG. 13.

FIGS. 13 to 15 illustrate a third embodiment of the present invention, wherein portions or components corresponding to those in the first embodiment are designated by like reference characters.

A first air assist passage 38 is provided in an inner fuel spray guide means 32 and opens in an opposed relation to a tip end of a pintle 34. The first air assist passage 38 is in communication with the air chamber 37 through an air supply passage 39 which is provided in the support arm $\mathbf{17}_2$ and the cap 17. A recess is provided around an outer periphery of the outer fuel spray guide means 31 to define an air flow passage 40 between the recess and the fitting hole $\mathbf{17}_1$. The air flow passage 40 is in communication with the air chamber 37 (see FIG. 1) the rough a plurality of, e.g., three passages 41 provided in the cap 17 at circumferentially spaced apart distances. Moreover, a plurality of second air assist passages $\mathbf{42}_1$ are provided in the outer fuel spray guide means 31 and open toward the inner fuel spray guide 32 at a location corresponding to the fuel injection passage 33. The second air assist passages $\mathbf{42}_1$ are commonly in communication with the air flow passage 40.

Thus, when fuel under high pressure is injected from the fuel injection hole $\mathbf{16}_3$, such fuel is atomized by collision against the tapered surface $\mathbf{34}_1$ of the valve head $\mathbf{34}_3$ of the pintle 34, while being radially diffused. During this time, assist air blown through the first air assist passage 38 in the inner fuel spray guide means 32 toward the tip end of the pintle 34 is diffused by collision against the tapered surface $\mathbf{34}_2$ of the valve head $\mathbf{34}_3$ and uniformly mixed with the atomized fuel. Moreover, the assist air is supplied through the first air assist passage 38 in a counter flow with respect to the fuel flow and therefore, the air flow collides against the fuel flow at a relatively large speed, thereby further promoting the atomization of the fuel and providing the stabilization of particle size.

The atomized fuel is ejected to the outside via the fuel injection passage 33, but the assist air from the plurality of second air assist passages $\mathbf{42}_1$ is blown to the fuel flow in the fuel injection passage 33. Therefore, the atomization of the fuel is further promoted, and for example, the atomization into 60 μm or less can be achieved. If the atomization of the fuel is performed, the stabilization of the fuel discharge form is generally difficult, but can be achieved by injecting the spray fuel along with the assist air from the first air assist passage 38 and the plurality of second air assist passages $\mathbf{42}_1$. Therefore, the spray fuel atomized, uniformized and stabilized in discharge form can be supplied into the combustion chamber 3 in the engine, leading to an enhanced efficiency of combustion in the combustion chamber 3.

Figure 16:
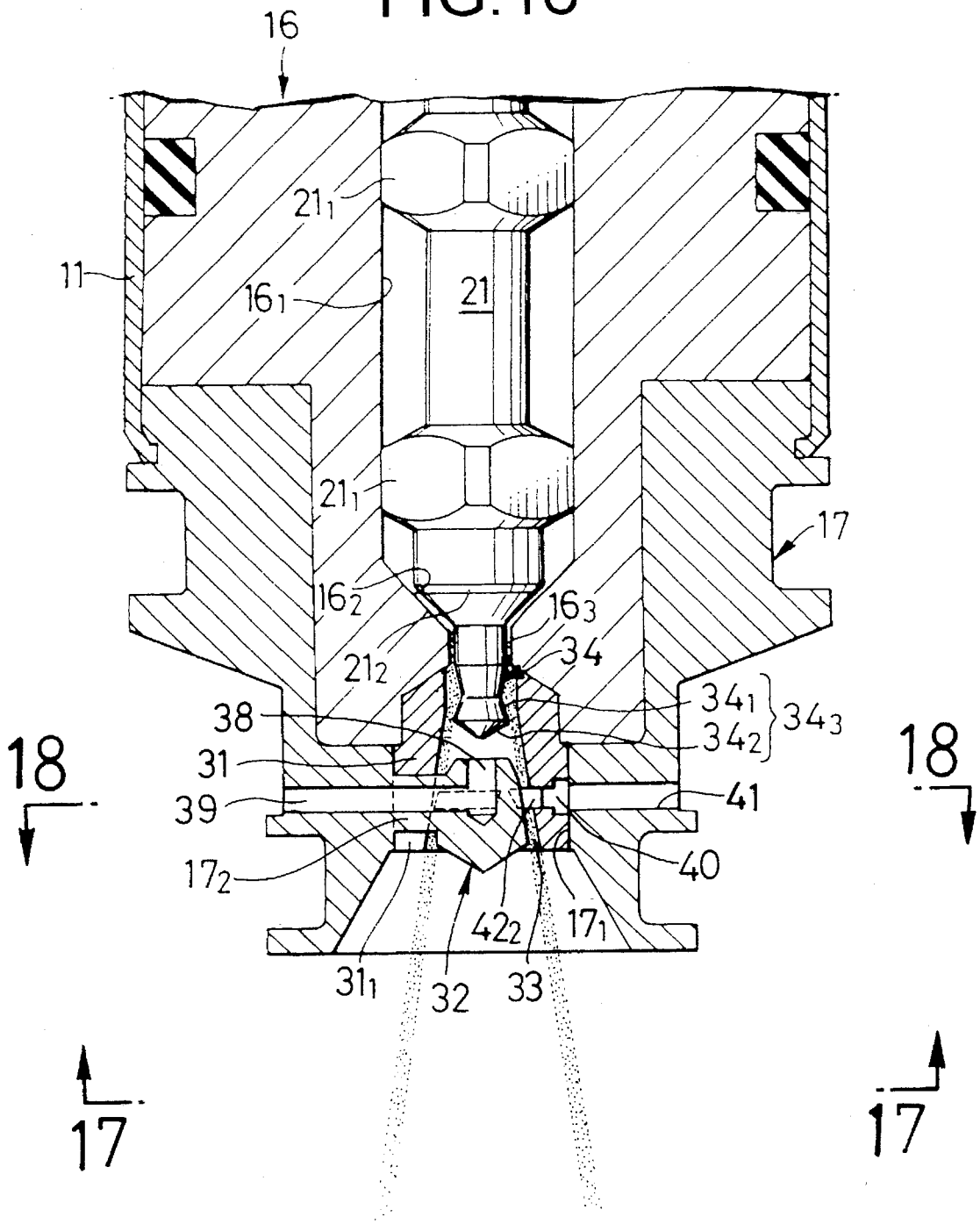
FIG. 16 is a vertical sectional side view of an essential portion of a solenoid type fuel injection valve according to a fourth embodiment of the present invention.
Figure 17:
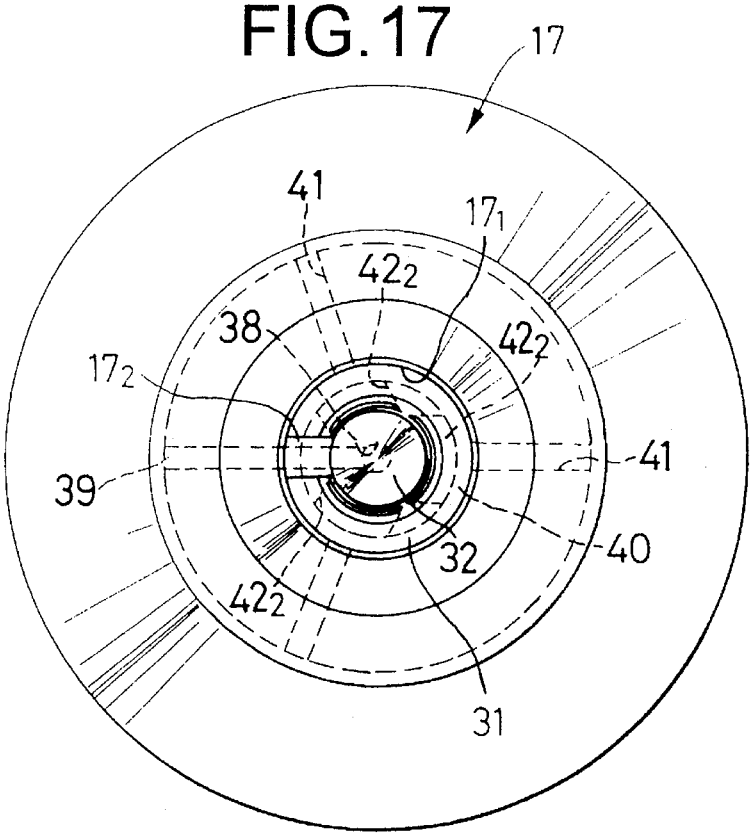
FIG. 17 is a view taken along a line 17—17 in FIG. 16.
Figure 18:
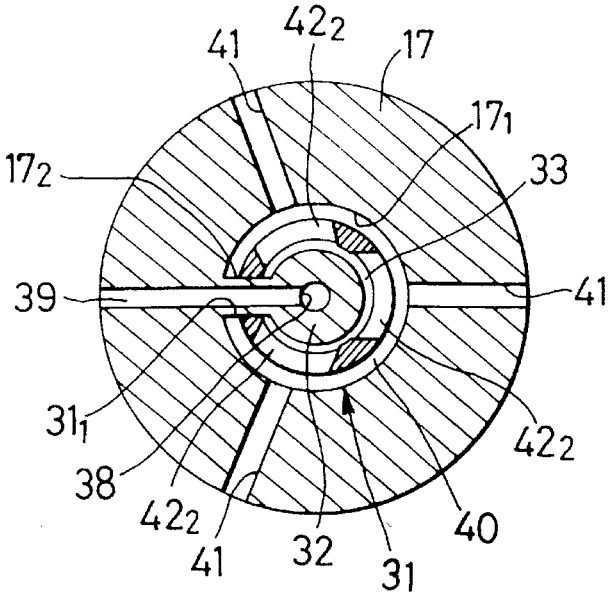
FIG. 18 is a sectional view taken along a line 18—18 in FIG. 16.

FIGS. 16, 17 and 18 illustrate a fourth embodiment. In this embodiment, a plurality of, e.g., three second air assist passages $\mathbf{42}_2$ are provided in the form of circumferentially long slits at circumferentially spaced apart distances in the outer fuel spray guide means 31 and open toward the inner fuel spray guide means 32 at a location corresponding the fuel injection passage 33. The second air assist passages $\mathbf{42}_2$ are commonly in communication with the air flow passage 40.

Even with the fourth embodiment, an effect similar to that in the third embodiment can be provided.

Although the embodiments of the present invention have been described in detail, it will be understood that the present invention is not limited to these embodiments, and various modifications in design may be made without departing from the spirit and scope of the invention defined in claims.

What is claimed is:

1. A solenoid type fuel injection valve comprising:

a fuel injection hole formed in an injector body and opened and closed by a needle valve;

a cylindrical fuel spray guide means provided at a position downstream of said fuel injection hole for limiting a spray angle of a fuel;

a pintle provided at a tip end of said needle valve to extend through said fuel injection hole into said fuel spray guide means for atomizing the fuel passed through said fuel injection hole; and an air assist passage disposed within said fuel spray guide means at a position downstream of said pintle and coaxially opposed to a tip end of said pintle.

2. A solenoid type fuel injection valve according to claim 1, wherein a cap is mounted at a tip end of said injector body, wherein said cylindrical fuel spray guide means comprises:

a cylindrical outer fuel spray guide means retained within said cap and an inner fuel spray guide means disposed within said outer fuel spray guide means at a position downstream of said pintle and coaxially opposed to the tip end of said pintle, and wherein a support arm extends radially inwardly from said cap for supporting said inner fuel spray guide means.

3. A solenoid type fuel injection valve according to claim 2, wherein a plurality of the support arms are provided.

4. A solenoid type fuel injection valve according to claim 2, wherein a fuel spray is guided by an inner wall of said outer fuel spray guide means and an outer wall of said inner fuel spray guide means.

5. A solenoid type fuel injection valve according to claim 2, wherein said inner fuel spray guide means is provided at an outer wall thereof with annular steps.

6. A solenoid type fuel injection valve according to claim 1, wherein the tip end of said pintle is tapered toward an opening of said opposed air assist passage.

7. A solenoid type fuel injection valve according to claim 6, wherein said pintle has a further portion continuous with said tapered tip end, said further portion being tapered toward said fuel injection hole.

8. A solenoid type fuel injection valve comprising a fuel injection hole provided in an injector body and capable of opening and closing by a needle valve, wherein assist air can be supplied toward a fuel flow injected through said fuel injection hole, said fuel injection valve further including:

a cylindrically formed outer fuel spray guide means provided in said injector body at a position downstream of said fuel injection hole for limiting a spray angle of a fuel;

a pintle provided at a tip end of said needle valve to extend through said fuel injection hole and inserted into said outer fuel spray guide means;

an inner fuel spray guide means fixedly disposed within said outer fuel spray guide means and coaxially opposed to said pintle;

a fuel injection passage formed between said inner fuel spray guide means and said outer fuel spray guide means;

a first air assist passage which is provided in said inner fuel spray guide means and which opens in an opposed relation to a tip end of said pintle; and a plurality of second air assist passages which are provided in said outer fuel spray guide means at a position corresponding to said fuel injection passage and which open toward said inner fuel spray guide means.

* * * * *